US008863896B1

(12) United States Patent
Kang

(10) Patent No.: US 8,863,896 B1
(45) Date of Patent: Oct. 21, 2014

(54) VECTORIZED JET FAN

(71) Applicant: Kai Kang, Nutley, NJ (US)

(72) Inventor: Kai Kang, Nutley, NJ (US)

( * ) Notice: Subject to any disclaimer, the term of this patent is extended or adjusted under 35 U.S.C. 154(b) by 63 days.

(21) Appl. No.: 13/857,369

(22) Filed: Apr. 5, 2013

(51) Int. Cl.
*E04F 17/04* (2006.01)
*F01N 13/02* (2010.01)
*F04D 25/08* (2006.01)

(52) U.S. Cl.
CPC ..... *F04D 25/08* (2013.01)
USPC ..... 181/224; 181/225; 415/119

(58) Field of Classification Search
USPC ..... 181/224, 225; 415/119
See application file for complete search history.

(56) References Cited

U.S. PATENT DOCUMENTS

| | | | | |
|---|---|---|---|---|
| 3,841,434 | A * | 10/1974 | Culpepper, Jr. | 181/224 |
| 6,260,658 | B1 * | 7/2001 | Darrell et al. | 181/224 |
| 6,543,575 | B1 * | 4/2003 | Marcellus | 181/224 |
| 2010/0074728 | A1 * | 3/2010 | Sinzaki | 415/119 |

FOREIGN PATENT DOCUMENTS

EP 1050684 A2 * 11/2000 ..... F04D 29/54

OTHER PUBLICATIONS

Costeris, N. 'Impulse Fans'. In: Proceedings of 7th International Symposium on Aerodynamics and Ventilation of Vehicle Tunnels. British Hydromechanical Research Group (BHRG). Brighton, UK, Nov. 27-29, 1991, p. 827-846, especially figures 8 and 11.*

Wolski, JK. 'Performance analysis of jet fan as booster fan'. In: Proceedings of 7th US Mine Ventilation Symposium. Society for Mining, Metallurgy & Exploration, Lexington, Kentucky, Jun. 5-7, 1995, p. 385-389, especially pp. 388 and 389, figures 5, 6 and 7.*

Tarada, F, Brandt, R. 'Impulse ventilation for tunnels—a state of the art review'. In: Proceedings of 13th International Symposium on Aerodynamics and Ventilation of Vehicle Tunnels. BHRG. New Brunswick, New Jersey, USA, May 13-15, 2009, p. 95-107, especially p. 106, figures 10 and 12.*

Witt KC, Schutze J. 'Bend it like a Banana'. In: Proceedings of 12th International Symposium on Aerodynamics and Ventilation of Vehicle Tunnels. BHRG. Portoroz, Slovenia, Jul. 11-13, 2006, p. 683-693, especially table 1 and figures 2, 3 and 4.*

Chapter 15, Enclosed Vehicular Facilities. In: ASHRAE Handbook—HVAC Applications. American Society of Heating, Refrigeration and Air-Conditioning Engineers (ASHRAE), Atlanta, GA, 2011, especially figure 24.*

* cited by examiner

*Primary Examiner* — Jeremy Luks

(57) ABSTRACT

A vectorized jet fan device for ventilation which is capable of directing high speed air stream discharged from the fan by a small angle at a higher flow speed for the primary purposes of efficiently meeting and utilizing space clearance and improving aerodynamic performance. The inventive device includes a splitter, through which an end silencer and a silencer is securely connected to the end of a fan. The splitter is formed so that the end silencer of a smaller diameter than the silencer can be fittingly engaged at a small degree of angle from the longitudinal axis of the fan.

15 Claims, 4 Drawing Sheets

© 2013 Kai Kang

© 2013 Kai Kang

© 2013 Kai Kang

© 2013 Kai Kang

© 2013 Kai Kang

VECTORIZED JET FAN

In accordance with 37 CFR 1.71(e), a portion of the disclosure of this patent document contains material which is subject to copyright protection. The copyright owner has no objection to the facsimile reproduction by anyone of the patent document or the patent disclosure, as it appears in the Patent and Trademark Office patent file or records, but otherwise reserves all copyright rights whatsoever.

CROSS-REFERENCE TO RELATED APPLICATIONS

Not Applicable

STATEMENT REGARDING FEDERALLY SPONSORED RESEARCH OR DEVELOPMENT

Not Applicable

REFERENCE TO SEQUENCE LISTING, A TABLE, OR A COMPUTER PROGRAM LISTING COMPACT DISC APPENDIX

Not Applicable

BACKGROUND OF THE INVENTION

1. Field of the Invention

The present invention relates generally to jet fan devices and more specifically it relates to a vectorized jet fan device for providing a jet fan which is capable of being utilized as a ventilation fan device for turning the flow of airstream from the fan by a small angle and increasing the airstream velocity through a smaller diameter silencer for efficiently meeting and utilizing space clearance and improving aerodynamic and ventilation performance.

2. Description of the Related Art

Jet fan devices have been in use for years. Typically, conventional jet fan devices are tubular in shape. Such a jet fan device generally consists of a fan-motor unit, for which the nominal diameter and typical length of the fan housing is represented by "D", and on each end of the fan housing, there is a tubular "silencer" that is used to reduce the aerodynamic noise from the high speed air flow from the fan. The length of the silencer generally varies and is typically 2D. The interior diameter of the silencers and fan housing are generally the same and through which air is drawn in from one end and discharged towards the other end. The "silencer-fan-silencer" jet fan device therefore forms a straight-through flow device, which is typically installed using a jet fan support system including hang from the ceiling, attach to the sidewalls or the ground. This device is generally used for space ventilation and control of fire and smoke, particularly for vehicular tunnels.

While conventional jet fan devices may be suitable for the particular purpose to which they address, the main problems of using these devices are installation space clearance and aerodynamic performance. As most often there is limited space for installation of these devices, which limits the diameter of the fan that can be used. And usually the jet fan devices are installed close to the wall, where for the high speed flow of the air stream discharged from the device, the flow speed may be as high as 6,000 to 8,000 feet per minute. The proximity of this air stream to the wall generally causes extra friction losses at the wall, which then may significantly reduce the aerodynamic performance.

One approach to address these problems for conventional jet fan devices is a special design configuration of a niche at the structural wall, where the surface of the wall for jet fan installation has to be recessed by a certain distance, so as to satisfy installation space clearance. The transition from the recessed surface is typically an inclined surface of a small degree of angle, generally extending for an extended distance from either end of the jet fan device. The cost of labor for constructing and maintaining the niche space such as for cleaning of debris can be very expensive.

To our knowledge there are no examples of US patents on jet fan devices that fully address both problems of installation space clearance and aerodynamic performance. The only illustrative example of prior art is German Patent No. 1050684 to Witt, which discloses a jet fan device with a customized slanted silencer attached to the fan. The silencer and so its airway is inclined at a small angle, typically 7 degrees from the fan housing centerline, so that the discharged air stream is directed away from the wall surfaces, which has shown convincing proofs of advantageous aerodynamic performance from a number of field testing in vehicular tunnels (4). It was claimed that 25-50% reduction in losses could be achieved as opposed to using conventional jet fan devices. Due to the slanted silencer design, the installation space of such devices, however, is generally larger than conventional jet fan devices.

In these respects, the vectorized jet fan according to the present invention substantially departs from the conventional devices and designs of the prior art, and in so doing provides a device primarily developed for the purposes of efficiently meeting and utilizing space clearance, and improving aerodynamic performance.

BRIEF SUMMARY OF THE INVENTION

In view of the foregoing problems inherent in the conventional jet fan devices now present in the prior art, the present invention provides a new vectorized jet fan device which can be utilized for efficiently meeting and utilizing space clearance, and improving aerodynamic performance.

The present invention generally comprises typical components of conventional jet fan devices mentioned heretofore, and an additional component, which is referred to as "splitter", is used as a transition piece. The splitter could be used at any position downstream of the fan housing, and in doing so, it would be necessary that the silencer that is used in conventional jet fan devices be separated into two pieces. Hence, for vectorized jet fan devices, it may be pertinently regarded and outlined as "silencer-splitter-silencer-fan-silencer-splitter-silencer", in which the silencer at each end is hereafter referred to as "end silencer".

A primary object of the present invention is to provide a vectorized jet fan device that will overcome the shortcomings of the prior art devices.

A second object is to provide a vectorized jet fan device that provides greater flexibility in different combinations of the fan housing diameter and the end silencer diameter.

Another object is to provide a vectorized jet fan device that is approximately the same weight as a conventional jet fan device of similar geometric dimensions.

Another object is to provide a vectorized jet fan device that potentially allows the air discharged from the fan to be directed, in small degree of angle from the centerline of fan housing, towards any radial direction.

Another object is to provide a vectorized jet fan device that potentially allows the air discharged from the fan to increase its flow speed, because of the reduction in cross sectional area of the splitter and the same for the end silencer.

A further object of the present invention is to provide a separate component of jet fan support system for attachment and installation, as may be attained using the splitter, which can be replaced without affecting other components of the vectorized jet fan device.

Further objects of the invention will appear as the description proceeds. Other objects and advantages of the present invention will become obvious to the reader and it is intended that these objects and advantages are within the scope of the present invention.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE SEVERAL VIEWS OF THE DRAWINGS

Various other objects, features and attendant advantages of the present invention will become fully appreciated as the same becomes better understood when considered in conjunction with the accompanying drawings, in which like reference characters designate the same or similar parts throughout the several views. As the vectorized jet fan devices are generally tubular in shape, it is perceived that side view would be sufficient to illustrate the features of the present invention, though an exploded view is included. These features are presented in increasing order of complexity that the present invention is intended to accomplish, which are not necessarily drawn to scale, and wherein.

DETAILED DESCRIPTION OF THE INVENTION

A. Overview

Various embodiments of the invention are described more fully hereinafter with reference to the accompanying drawings, in which some, but not all embodiments of the invention are shown in the figures. Indeed, the features of the present invention may be embodied in many different forms and should not be construed as limited to the embodiments set forth herein; rather, these embodiments are provided so that this disclosure will satisfy applicable legal requirements.

Figure 1:
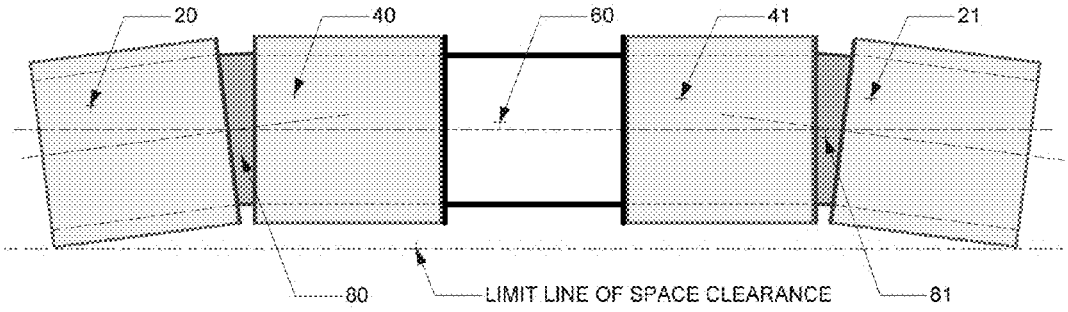
FIG. 1 illustrates a side view a vectorized jet fan device in which the splitter is used to only direct the direction of the discharged airflow by a small degree of angle from the centerline of fan housing.
Figure 2:
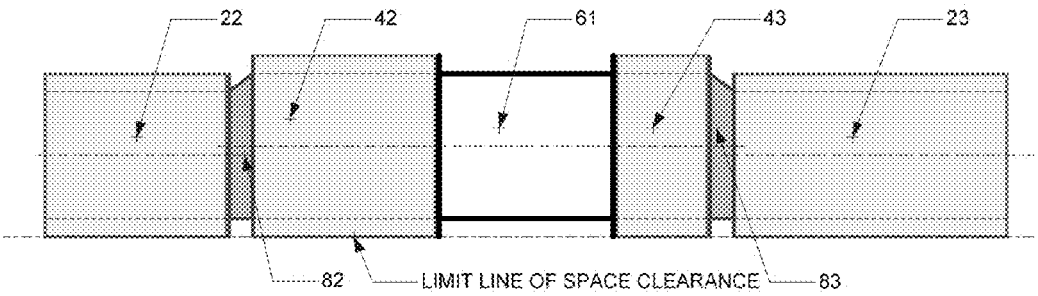
FIG. 2 illustrates a side view of a vectorized jet fan device in which the splitter is used to only reduce the diameter of end silencer.
Figure 3:
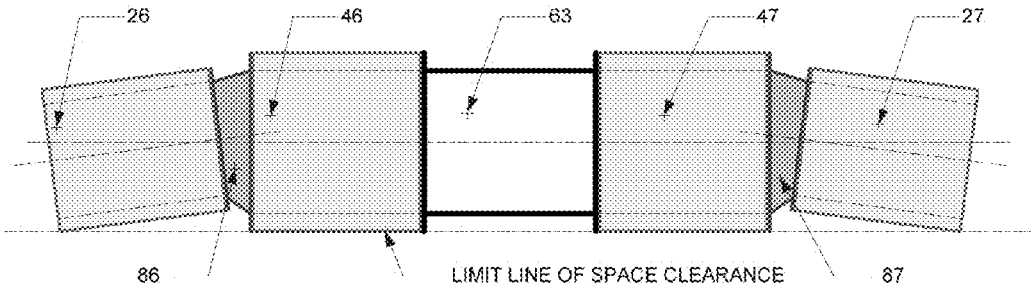
FIG. 3 illustrates a side view of a vectorized jet fan device in which the splitter is used to accomplish both functions as described in FIG. 1 and FIG. 2.

The present invention of vectorized jet fan, generally outlined as "silencer-splitter-silencer-fan-silencer-splitter-silencer", which may be considered as essential components and because they are generally tubular in shape, the use of "centerline" refers to geometric longitudinal axis, which are used interchangeably herein. The features of the invention is illustrated through the selected different construction forms of the splitter, as shown in FIGS. 1-3. FIG. 4 may be considered as a general description of the present invention. The materials of such type, dimension, and construction for all components, and their secure attachment to one another as shown herein shall preferably follow present fan industry practice and standards. These figures are described separately as follows.

B. FIG. 1

FIG. 1 illustrates a side view a vectorized jet fan device in which the splitter is used to only direct the direction of the discharged airflow by a small degree of angle from the centerline of fan housing. The centerline of the end silencer 20 is at a small degree of angle from the centerline of the fan housing 60. The end silencer 20 is securely attached to one end of the splitter 80, which is preferably of much shorter length, and the other end of the splitter 80 is securely attached to one end of the silencer 40, and the other end of the silencer 40 is securely attached preferably in the same manner to the fan housing 60. One the right side of the fan housing 60, it comprises the silencer 41, the splitter 81, and the end silencer 21, which are securely attached and assembled together preferably in the same manner as the components on the left side of the fan housing 60.

Generally it is not necessary that the lengths of the silencers 20, 40, 41, 21, are all the same but standard tubular silencer product is preferably to be used, and the interior diameters of the silencers 20, 40, 41, 21, are preferably the same as that of the splitter 80 and 81, and the fan housing 60. It is also not necessary to include both of the two splitters 80 and 81 as shown in FIG. 1, if the airflow to be generated by the jet fan device is intended for one direction only. FIG. 1 illustrates the limit line of space clearance as preferably delimited by the lowest point of the end silencer 20 or the end silencer 21, whichever extends the furthest from the centerline of the fan housing 60.

C. FIG. 2

FIG. 2 illustrates a side view of a vectorized jet fan device in which the splitter is used to only reduce the diameter of end silencer, which is to be accompanied by an increase in the flow speed of the discharged airflow. On the left side of the fan housing 61, the end silencer 22 is securely attached to the end of the splitter 82, and the other end of the splitter 82 is securely attached to the silencer 42, which is securely attached on the end to the fan housing 61. One the right side of the fan housing 61, it comprises the silencer 43, the splitter 83, and the end silencer 23, which are securely attached and assembled together preferably in the same manner as the components on the left side of the fan housing 61.

As shown in FIG. 2, there is a reduction in the cross sectional area of the splitter 82 and 83, so that the end silencer 22 and the end silencer 23, which has smaller diameters than those of the silencers 42 and 43, can be used. In this particular configuration, the interior diameters of the silencer 42, the silencer 43, and the fan housing 61 are preferably the same, and the interior diameters of the end silencer 22 and the end silencer 23 are preferably smaller; and the centerlines of the end silencer 22 and 23 are preferably to be in parallel with the centerline of the fan housing 61. It is also not necessary to include both of the two splitters 82 and 83 as shown in FIG. 2, if the airflow to be generated by the jet fan device is intended for one direction only. The general alignment of the end silencer 22 and the end silencer 23 and so the same for the splitter 82 and the splitter 83, shall preferably be such that they stay within the limit line of space clearance as noted in FIG. 2.

D. FIG. 3

FIG. 3 illustrates a side view of a vectorized jet fan device in which the splitter is used to accomplish both functions as described in FIG. 1 and FIG. 2. As shown in FIG. 3, on the left side of the fan housing 63, the end silencer 26 is securely attached to one end of the splitter 86, and the other end of the splitter 86 is securely attached to the silencer 46, the other end of which is securely attached to the fan housing 63. One the right side of the fan housing 63, it comprises the silencer 47, the splitter 87, and the end silencer 27, which are securely attached and assembled together preferably in the same manner as the components on the left side of the fan housing 63.

In this particular configuration, the centerline of the end silencer 26 and 27 is at a small degree of angle from the centerline of the fan housing 63. The interior diameters of the end silencers 26 and 27 are also smaller than the interior diameters of the silencers 46 and 47. The general alignment of these components shall preferably be such that they stay within the limit line of space clearance as noted in FIG. 3. If the airflow to be generated by the jet fan device is intended for both directions, it would be necessary to include both of the two splitters 86 and 87, and preferably their geometry features including lengths and interior diameters are the same.

E. FIG. 4

Figure 4A:
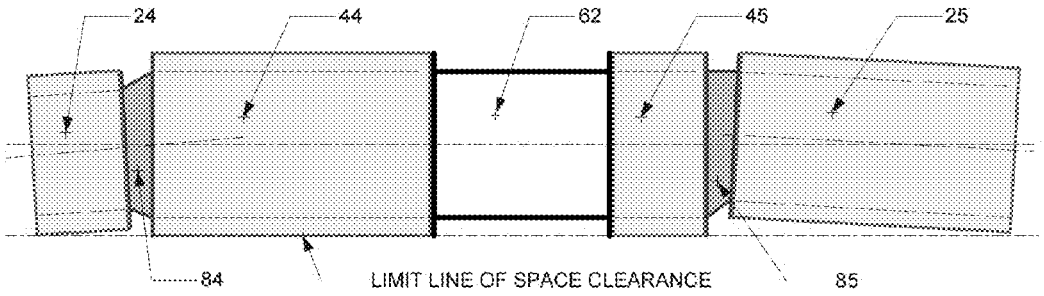
FIG. 4A illustrates a side view of the present invention of vectorized jet fan device.

FIG. 4A illustrates a side view of the present invention of vectorized jet fan device. On the left side of the fan housing 62, the end silencer 24 is securely attached to one end of the splitter 84, and the other end of the splitter 84 is securely attached to the silencer 44, which is securely attached on the end to the fan housing 62. One the right side of the fan housing 62, it comprises the silencer 45, the splitter 85, and the end silencer 25, which are securely attached and assembled together preferably in the same manner as the components on the left side of the fan housing 62.

In this particular configuration, the centerline of the end silencer 24 and 25 is at a small degree of angle from the centerline of the fan housing 62. The interior diameters of the end silencers 24 and 25 are also smaller than the interior diameters of the silencers 44 and 45. The general alignment of these components shall preferably be such that they stay within the limit line of space clearance as noted in FIG. 4A. If the airflow to be generated by the jet fan device is intended for one direction only, it is not necessary to include both of the two splitters 84 and 85, and it is also not necessary in general that the lengths of the silencers 44 and 45, and the end silencers 24 and 25 are all the same, but generally standard tubular silencer product is preferably to be used.

Figure 4B:
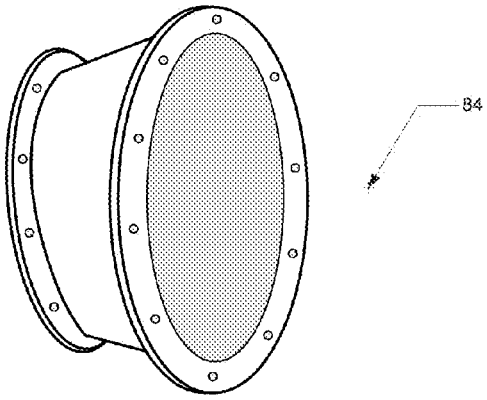
FIG. 4B illustrates an exploded view of a typical splitter.

FIG. 4B illustrates an exploded view of a typical splitter. The splitter 84 is preferably tubular in shape, but not necessarily of a uniform interior diameter and the two flanged ends not necessarily in parallel. Each flange shall preferably consist of a plurality of bolting holes or other means known in the art, which could be used for secure attachment of the splitter 84 to the silencer 44 and the end silencer 24.

As can be appreciated, various configurations may be utilized to construct the splitter 84, and as have shown from FIGS. 1-4, it can be noted that its primary functions are: (a) direct airflow from the jet fan device away from solid boundaries near the fan, and towards the centerline or desired direction for the ventilated space, primarily for improving aerodynamic performance, or (b) reduce the internal cross sectional area, allowing for the use of a smaller diameter end silencer, primarily for efficiently meeting and utilizing space clearance, or (c) both of the above (a) and (b).

The splitter 84 could be part of the jet fan support system, thereby possibly minimizing certain manufacturing necessities for the silencers used in conventional jet fan devices. The splitter 84 between the silencer 44 and the end silencer 24 should be customizable by rotating its position in the transverse plane, therefore, it may be regarded that the direction and the speed of the airflow discharged from the present invention of the jet fan device as shown in FIG. 4A can be vectorized and customizable, likely with no impact on space clearance and with improved aerodynamic performance.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed to be within the expertise of those skilled in the art, and all equivalent structural variations and relationships to those illustrated in the drawings and described in the specification are intended to be encompassed by the present invention. Therefore, the foregoing is considered as illustrative only of the principles of the present invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A vectorized jet fan device, comprising:

an axial fan housed in a tubular fan housing suitable for receiving secure connection on both ends;

a first end silencer and a first silencer securely connected using a first splitter, wherein said first silencer is securely attached to a first end of said fan housing;

a second end silencer and a second silencer securely connected using a second splitter, wherein said second silencer is securely attached to a second end of said fan housing;

wherein:

both ends of said first end silencer are perpendicular to a centerline of said first end silencer;

both ends of said second end silencer are perpendicular to a centerline of said second end silencer;

both ends of said first silencer are perpendicular to a centerline of said first silencer;

both ends of said second silencer are perpendicular to a centerline of said second silencer;

said centerline of said first silencer coincides with a centerline of said fan housing; and said centerline of said fan housing coincides with said centerline of said second silencer.

2. The vectorized jet fan device of claim 1, wherein said first splitter having both ends suitable for receiving secure connection, wherein a first end of said first splitter is securely attached to said first end silencer and a second end of said first splitter is securely attached to said first silencer, and wherein an internal diameter of said first end of said first splitter is approximately equal to an internal diameter of said first end silencer, and an internal diameter of said second end of said first splitter is approximately equal to an internal diameter of said first silencer.

3. The vectorized jet fan device of claim 2, wherein said second splitter having both ends suitable for receiving secure connection, wherein a first end of said second splitter is securely attached to said second end silencer and a second end of said second splitter is securely attached to said second silencer, and wherein an internal diameter of said first end of said second splitter is approximately equal to an internal diameter of said second end silencer, and an internal diameter of second end of said second splitter is approximately equal to an internal diameter of said second silencer.

4. The vectorized jet fan device of claim 3, wherein said centerline of said first end silencer is positioned at a small degree of angle from said centerline of said fan housing.

5. The vectorized jet fan device of claim 4, wherein said centerline of said second end silencer is positioned at a small degree of angle from said centerline of said fan housing.

6. The vectorized jet fan device of claim 3, wherein said internal diameter of said first end silencer is approximately equal to or smaller than said internal diameter of said first silencer.

7. The vectorized jet fan device of claim 6, wherein said internal diameter of said second end silencer is approximately equal to or smaller than said internal diameter of said second silencer.

8. The vectorized jet fan device of claim 4, wherein said internal diameter of said first end silencer is approximately equal to or smaller than said internal diameter of said first silencer.

9. The vectorized jet fan device of claim 5, wherein said internal diameter of said second end silencer is approximately equal to or smaller than said internal diameter of said second silencer.

10. The vectorized jet fan device of claim 9, wherein said internal diameter of said first end silencer is approximately equal to or smaller than said internal diameter of said first silencer.

11. A vectorized jet fan device, comprising:

an axial fan housed in a tubular fan housing suitable for receiving secure connection on both ends;

an end silencer and a first silencer securely connected using a splitter, wherein said first silencer is securely attached to a first end of said fan housing;

a second silencer securely attached to a second end of said fan housing;

wherein:

both ends of said end silencer are perpendicular to a centerline of said end silencer;

both ends of said first silencer are perpendicular to a centerline of said first silencer;

both ends of said second silencer are perpendicular to a centerline of said second silencer;

said centerline of said first silencer coincides with a centerline of said fan housing; and said centerline of said fan housing coincides with said centerline of said second silencer.

12. The vectorized jet fan device of claim 11, wherein said splitter having both ends suitable for receiving secure connection, wherein a first end of said splitter is securely attached to said end silencer and a second end of said splitter is securely attached to said first silencer, and wherein an internal diameter of said first end of said splitter is approximately equal to an internal diameter of said end silencer, and an internal diameter of said second end of said splitter is approximately equal to an internal diameter of said first silencer.

13. The vectorized jet fan device of claim 12, wherein said centerline of said end silencer is positioned at a small degree of angle from said centerline of said fan housing.

14. The vectorized jet fan device of claim 12, wherein said internal diameter of said end silencer is approximately equal to or smaller than said internal diameter of said first silencer.

15. The vectorized jet fan device of claim 13, wherein said internal diameter of said end silencer is approximately equal to or smaller than said internal diameter of said first silencer.

* * * * *